United States Patent [19]

Church et al.

[11] Patent Number: 4,850,527

[45] Date of Patent: Jul. 25, 1989

[54] CARTON WITH SELF POSITIONING INTERLOCKING CORNERS

[75] Inventors: Gordon M. Church, Franklin; Michael A. Churvis, Murfreesboro, both of Tenn.

[73] Assignee: Heil-Quaker Corporation, LaVergne, Tenn.

[21] Appl. No.: 228,005

[22] Filed: Aug. 3, 1988

[51] Int. Cl.[4] ..... B65D 5/10; B65D 5/06

[52] U.S. Cl. ..... 229/110; 229/126; 229/41 C; 229/920

[58] Field of Search ..... 229/110, 918, 192, 920, 229/109, 108, 126, 41 C

[56] References Cited

U.S. PATENT DOCUMENTS

| | | | |
|---|---|---|---|
| 397,980 | 2/1989 | Griest . | |
| 1,693,435 | 11/1928 | Clarke . | |
| 2,013,691 | 9/1935 | Martinson . | |
| 2,517,552 | 8/1950 | Field . | |
| 2,565,188 | 8/1951 | Welshenbach | 229/109 |
| 2,733,851 | 2/1956 | Ness . | |
| 2,954,152 | 9/1960 | Buttery et al. . | |
| 2,967,655 | 1/1961 | Seger, Jr. | 229/109 |
| 3,174,675 | 3/1965 | Rosenburg, Jr. . | |
| 3,977,594 | 8/1976 | Swan . | |
| 4,146,169 | 3/1979 | Meyers et al. . | |
| 4,441,649 | 4/1984 | Nederveld . | |
| 4,511,080 | 4/1985 | Madsen et al. . | |

FOREIGN PATENT DOCUMENTS

| | | | |
|---|---|---|---|
| A090192 | 10/1967 | France | 229/110 |
| 1528721 | 6/1968 | France | 229/109 |

*Primary Examiner*—Stephen Marcus
*Assistant Examiner*—Jes F. Pascua
*Attorney, Agent, or Firm*—Jeffers, Hoffman & Niewyk

[57] ABSTRACT

A hexagonal carton including four upstanding sidewall panels and two diagonally opposed corner panels. The entire carton is formed from a single blank. The corner panels include minor flaps hingedly foldably connected thereto which interact with minor flaps foldably hingedly connected to the adjoining sidewall panels to form a rigid interlocked cover panel which withstands lateral pressures exerted on the sidewall panels of the carton. Major flaps are foldably hingedly connected to two of the sidewall panels to form a cover panel to cover the interlocking minor flaps.

9 Claims, 2 Drawing Sheets

CARTON WITH SELF POSITIONING INTERLOCKING CORNERS

BACKGROUND OF THE INVENTION

This invention pertains to a carton with self positioning interlocking corners and more specifically to a carton with interlocking corners for central air conditioning condensers.

Many cartons containing products are stacked on top of each other when the cartons are stored in warehouses. In the particular case of air conditioner condensers, these products are commonly stacked ten (10) units high. This stacking is accomplished by means of lift trucks which include a pair of clamping panels whereby several of the air conditioner condenser cartons may be grasped and clamped between the clamping panels of the lift truck and then lifted to be stacked. This process imposes lateral pressure on the cartons in which the air conditioner condensers are contained. It is of course desired that the cartons not be crushed or deformed during this stacking process. Accordingly, the cartons must have substantial strength to prevent this from happening. While the sides of the carton may have a substantial amount of "give", the top and bottom of the cartons must be relatively strong to prevent their buckling and deformation. Prior art cartons have not been satisfactory in this regard and it is therefore desired to provide a carton which is economical to manufacture yet is strong enough to withstand the clamping pressures generated by lift trucks during the stacking process.

Cartons must serve the essential function of protecting the products contained in the cartons from damage and from contamination by dust and the like. Many products, such as air conditioner condensers, have irregular shapes and may have one or more corners which are rounded and which therefore do not conform very easily to a standard rectangular carton. In the prior art, it has been common practice to provide filler material for the corners of containers, which filler material may consist of styrofoam fillers or fillers which are manufactured from folded cardboard. Such fillers add additional cost to the packaging of a product and are therefore undesirable. It is therefore desired to provide a container wherein the corners of the carton may be shaped to provide a good fit for the product contained in the carton.

In the packaging of certain products, such as air conditioner condensers, it may not be desirable to have a carton with both top and bottom panels. For instance, the function of an air conditioner condenser carton is primarily to protect the product from dust as well as damage. For that purpose, it is not necessary to provide a carton with a bottom panel. The carton must serve primarily as a dust cover which, however, must have sufficient strength to prevent its being crushed during the stacking process, as described above, and furthermore must provide adequate protection for the product. For that reason, it is desired to provide a half slotted carton, i.e. a carton which does not have a bottom, which has sufficient strength to withstand the clamping forces placed on the carton during the loading process and which effectively protects the product contained therein.

SUMMARY OF THE INVENTION

The present invention, in one form thereof, provides a carton formed from a single sheet of cardboard material, having four sidewall panels and one or more corner wall panels. One of the corner wall panels includes a flap which cooperates with a flap of one of the sidewall panels in self positioning, interlocking relationship to provide a cover having substantial strength in the horizontal plane. Additional flaps are provided on one or more of the remaining sidewall panels to form a top panel for the carton.

The present invention, in one form thereof, comprises a half slotted container or dust cover which is hexagonal in shape. Two of the corner panels include flaps which are folded horizontally and cooperate interlockingly with sidewall panel flaps to form a rigid and strong top panel which can withstand substantial horizontal forces thereon. Two of the remaining sidewall panels include flaps which serve as a dust cover for the carton. The carton does not include a bottom panel.

One advantage of the present invention is that the carton can be shaped to conform to the shape of a product contained therein and wherein the sidewall panels include flaps which cooperate to provide a top panel which is strong and prevents crushing of the container during stacking operations.

Another advantage of the carton according to the present invention is that a minimum of material is used to provide a carton which is rigid and strong and can be stacked and yet which will maintain its shape.

Still a further advantage of the carton according to the present invention is that no filler material needs to be provided to fill the corners and wedge the product tightly in the carton.

The present invention, in one form thereof, comprises a carton formed from a blank of foldable sheet material. The carton includes two pairs of upstanding generally parallel sidewall panels and two upstanding corner panels. Each of the corner panels are hingedly foldably connected to the sidewall panels intermediate and adjoining the sidewall panels. Two first minor cover forming flaps are hingedly foldably connected to respective first and second of the sidewall panels. Two second minor cover forming flaps are hingedly foldably respectively connected to two respective corner panels, each of the first minor flaps having a pair of edges which respectively abut with respective ones of a pair of mating edges of a respective one of said second minor flaps. Each of the pair of abutting edges includes an edge which is substantially parallel to the first pair of upstanding sidewall panels and another edge which is substantially parallel to the second pair of upstanding sidewall panels, whereby the minor flaps provide substantial lateral compressive strength for the carton. A pair of major flaps are provided which are hingedly foldably connected to the sidewall panels and substantially cover the minor flaps.

The present invention, in one form thereof, comprises a carton formed from a blank of foldable sheet material. First and second pairs of upstanding generally parallel sidewall panels are provided. A first upstanding corner panel is provided which is foldably hingedly secured intermediate to and adjoining the sidewall panels. One of the two adjoining wall panels includes a first minor flap hingedly foldably secured thereto. The first minor flap includes first and second edges which are respectively parallel to the first and second pairs of sidewall panels. A second minor flap is hingedly foldably secured to the corner panel. The second minor flap includes third and fourth edges. The second minor flap is adapted to position itself with respect to the first minor flap in the assembled carton whereby the first and third and the second and fourth edges are in respective abutting relationship.

It is an object of the present invention to provide a carton which is not readily crushed due to pressures exerted thereon during the stacking and loading operations.

It is another object of the present invention to provide a strong, crush-proof carton which can be formed from a unitary sheet of cardboard material.

Still a further object of the present invention is to provide a strong half slotted carton and which is closely fitted to the product contained therein.

Yet still another object of the present invention is to provide a half slotted carton wherein no filler material is needed in the corners of the carton to conform the carton to the product contained therein.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
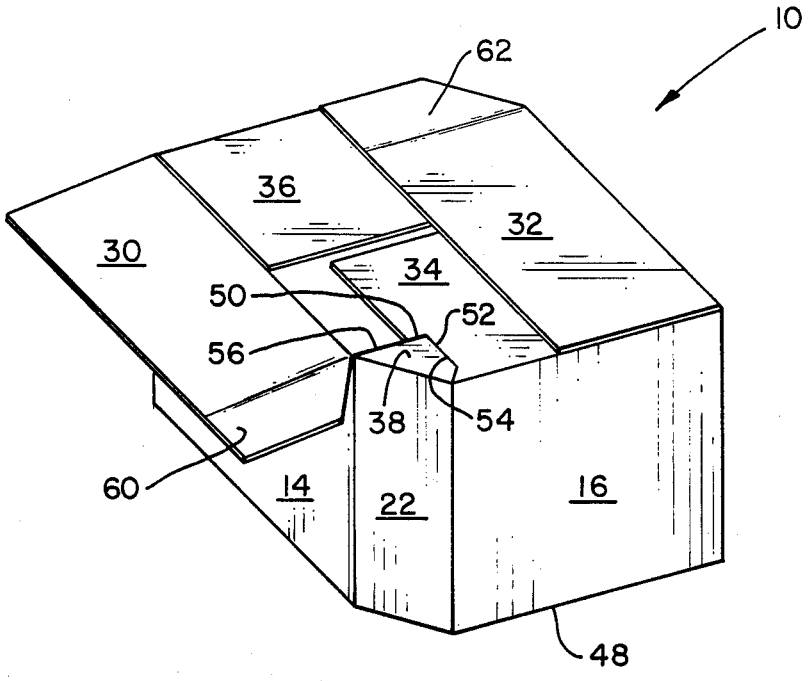
FIG. 1 is a perspective view of the carton according to the present invention.
Figure 2:
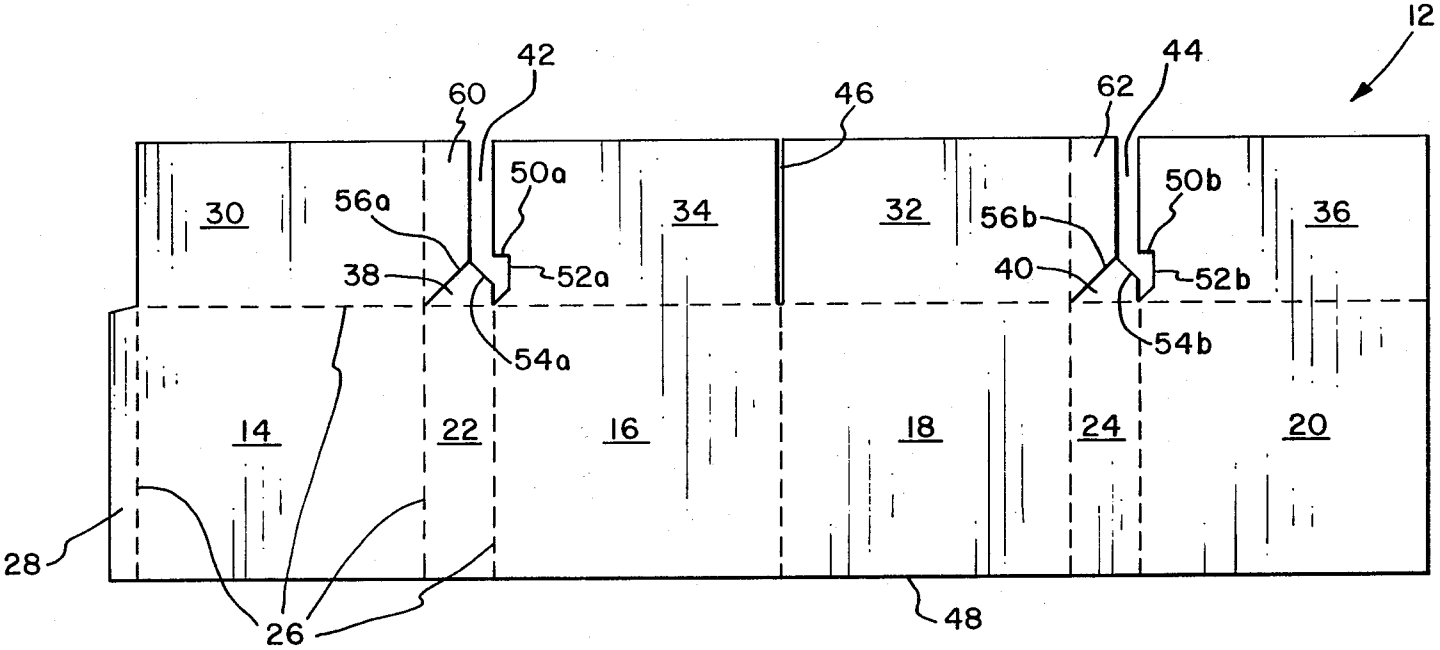
FIG. 2 is a plan view of a blank for the carton of FIG. 1.

Referring to FIGS. 1 and 2, there is shown a carton 10 according to the present invention which is formed of a sheet blank 12 of cardboard material or the like. Carton 10 is formed from a unitary blank 12 including sidewall portions 14, 16, 18 and 20. Furthermore, two corner wall portions 22 and 24 are shown which respectively separate sidewall portions 14, 16 and 18, 20. It should be noted that in FIG. 2 the dotted lines 26 are fold lines along which blank 12 is folded in order to form the various flap and wall portions thereof as further described hereinafter.

An overlap portion 28 adjoins sidewall 14 whereby, when blank 12 is folded, overlap portion 28 may be secured to sidewall 20 such as by means of an adhesive. A major flap 30 also adjoins sidewall 14 and another major flap 32 adjoins sidewall 18. Minor flaps 34 and 36 respectively adjoin respectively sidewalls 16 and 20. Additional minor flaps 38 and 40 are provided which respectively adjoin corner walls 22 and 24. A portion 42 is removed between minor flaps 34 and 38 and similarly a portion 44 is removed between minor flaps 36 and 40. In the blank of FIG. 2 the bottom edge of the carton is indicated at 48.

Figure 4:
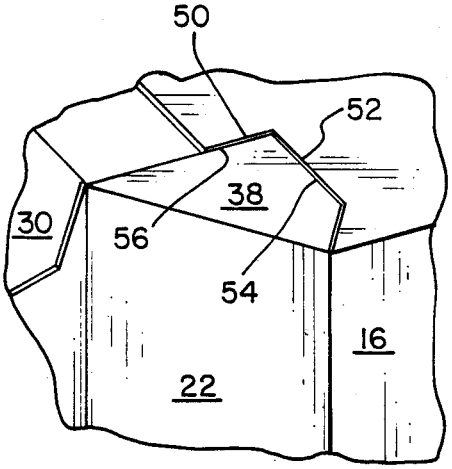
FIG. 4 is a broken away perspective view of a portion of a corner of the assembled carton of FIG. 1.
Figure 3:
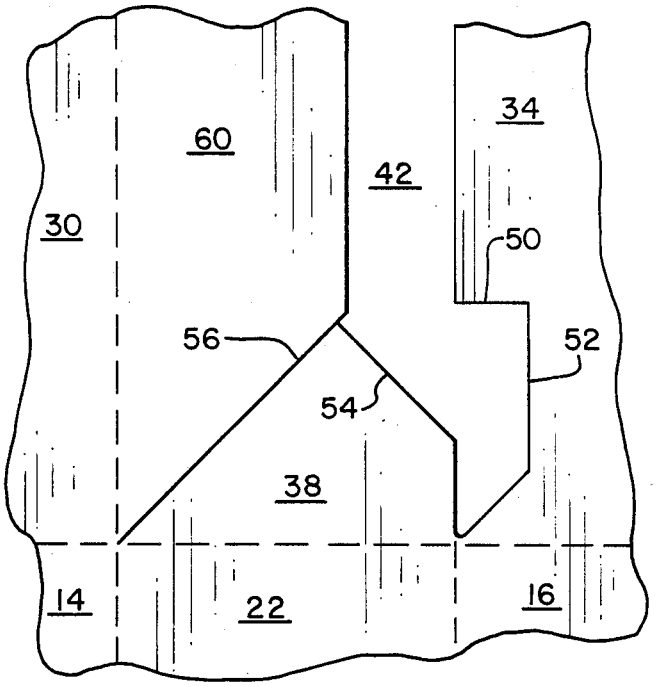
FIG. 3 is an enlarged broken away view of a portion of the blank of FIG. 2.

When the blank 12 is folded along fold lines 26, various portions of blank 12 assume mutually abutting positions to provide a carton cover which has great rigidity and wherein portions of the cover interlock. Thus referring to blank 12 of FIG. 2, it should be noted that mating edges 50*a* and 50*b*, 52*a* and 52*b*, 54*a* and 54*b*, and 56*a* and 56*b* are so oriented that in the folded assembled position of the carton, these edges will mutually abut to provide lateral rigidity for the cover. Several of these edges of the carton are shown in more detail in FIGS. 3 and 4 for the assembled carton to illustrate their function. Thus, for instance, it can be seen that edge 50 will abut with edge 56 when the carton is assembled. Similarly edge 52 will abut edge 54. With reference to FIGS. 1 and 4, it can be seen that all of the abutting edges of the assembled carton are parallel to the major sidewall panels of the assembled carton. Thus for instance, edges 50 and 56 are parallel to sidewall panels 16 and 20. Similarly, edges 52 and 54 are parallel to sidewall panels 14 and 18. It should be noted that these edges, upon the folding of minor flaps 38, 34 and 40, 36, are self positioning and interlock in such a way that pressure placed on the carton by the clamping panels of a lift truck which clamp either sidewall panels 16, 20 or 14, 18, will result in clamping pressures upon respective abutting edges 50, 56 and 52, 54 which resist the clamping pressure and make the carton cover laterally rigid so that it retains its shape. Since side panels 14, 16, 18 and 20 are relatively flexible, it can therefore be seen that the lateral rigidity of the carton is due primarily to the interlocking minor portions of the top namely, interlocking minor flaps 34, 36, 38 and 40.

It should also be noted that minor flaps 38 and 40 are made available by the provision of upstanding corner panels 22 and 24. Upstanding corner panels 22 and 24 are provided at approximately 45° to sidewall panels 14, 16 and 18, 20. The provision of these upstanding corner panels enable the carton 10 to more closely fit certain products. The carton illustrated in the preferred embodiment is intended for packaging condensing units for a central air conditioner. Such units may have one or more rounded corners. In order to provide a good fit between the carton and the condenser unit, corner panels 22 and 24 are provided which thereby eliminate the need for corner fillers such as traditionally have been used in packaging irregularly shaped items in rectangular cartons. Preferably, corner panels 22 and 24 are provided at diagonally opposite corners of the carton, although it is contemplated that carton 10 could be provided with corner panels 22 and 24 in adjoining corners. Furthermore by the provision of the corner panels 22 and 24, minor flaps 38 and 40 are provided for cooperating with minor panels 34 and 36 for providing a rigid carton top as set forth hereinabove. It should be noted that more or fewer corner panels 22 and 24 may be provided in order to accommodate the shape of the item to be contained in the carton and furthermore in order to provide even greater rigidity for the carton cover. Referring further to FIG. 1, it can be seen that major flaps 30 and 32 are provided to cover minor flaps 34, 36, 38 and 40 in the assembled position of carton 10. Flaps 60 and 62 are integrally formed with flaps 30 and 32. In the illustrated embodiment of FIG. 1, flap 30 is shown in the open position but, in the fully assembled position, flap 30 would be folded over onto minor flaps 34, 36 and 38.

It should be noted from FIGS. 1 and 2 that no bottom panel is provided for the carton. Thus the carton disclosed is a half slotted carton wherein edge 48 is the lower edge of the carton. It would of course be possible to provide a bottom panel in the same fashion as a top panel as shown for the blank of FIG. 2. However, the illustrated carton serves as a dust cover and therefore need not have a bottom. When air conditioner condensers contained in carton 10 are stacked, vertical stacking rigidity is provided by the rigidity of the product itself, not by the carton 10. Typically an inch and a half (1½") of the bottom of the product is not covered by the carton.

While this invention has been described as having a preferred design, it will be understood that it is capable of further modification. This application is therefore intended to cover any variations, uses or adaptations of the invention following the general principles thereof and including such departures from the present disclosure as come within known or customary practice in the art to which this invention pertains and fall within the limits of the appended claims.

What is claimed is:

1. A carton formed from a blank of foldable sheet material comprising:

two pairs of upstanding, generally parallel sidewall panels;

two upstanding corner panels, each said corner panel hingedly foldably connected to said sidewall panels intermediate and adjoining said sidewall panels;

two first minor cover forming flaps hingedly foldably connected to respective first and second said sidewall panels;

two second minor cover forming flaps hingedly, foldably connected to said two respective corner panels, each of said first minor flaps having a pair of edges which respectively abut with respective ones of a pair of edges of a respective one of said second minor flaps, each of said pair of edges including one edge which is substantially parallel to a first pair of said upstanding sidewall panels and another edge which is substantially parallel to a second pair of upstanding sidewall panels, whereby said minor flaps provide substantial lateral compressive strength for said carton; and a pair of major flaps hingedly foldably connected to two of said sidewall panels and substantially covering said minor flaps.

2. The carton according to claim 1 wherein said blank consists of a unitary sheet of material.

3. The carton according to claim 1 having an open bottom.

4. The carton according to claim 1 wherein two of said upstanding wall panels include major flaps adapted to form a cover panel for covering substantially said entire carton and all said minor flaps.

5. A carton formed from a blank of foldable sheet material comprising:

first and second pairs of upstanding generally parallel sidewall panels;

a first upstanding corner panel foldably hingedly secured intermediate to and adjoined to two of said sidewall panels;

one of said two adjoining side wall panels including a first minor flap hingedly foldably secured thereto, said first minor flap including first and second edges respectively parallel to said first and second pairs of sidewall panels; and a second minor flap hingedly foldably secured to said corner panel, said second minor flap including third and fourth edges, said second minor flap adapted to position itself with respect to said first minor flap in the assembled carton whereby said first and third edges and said second and fourth edges are in respective abutting relationship.

6. The carton according to claim 5 and including a third minor flap hingedly foldably secured to a sidewall panel and including fifth and sixth edges respectively parallel to said first and second pairs of sidewall panels, a second upstanding corner panel generally parallel to said first corner panel and having a fourth minor flap hingedly foldably secured to said second corner panel and including seventh and eighth edges, said fourth minor flap adapted to position itself with respect to said third minor flap whereby said fifth and sixth edges and said seventh and eighth edges are in respective abutting relationship.

7. The carton according to claim 6 wherein said corner panels are substantially parallel.

8. The carton according to claim 5 wherein two of said upstanding wall panels include major flaps adapted to form a cover panel for covering substantially said entire carton and said minor flaps.

9. The carton according to claim 5 wherein portions of said blank sheet are removed, said removed portions separating said abutting edges in the unassembled position of said blank.

* * * * *